US005350232A

United States Patent [19]

Kreuziger

[11] Patent Number: 5,350,232

[45] Date of Patent: Sep. 27, 1994

[54] DEVICE FOR MIXING, HOMOGENIZING OR REACTING AT LEAST TWO COMPONENTS

[76] Inventor: Wolf-Dieter Kreuziger, Theresiengasse 17, A-1180 Vienna, Austria

[21] Appl. No.: 64,130

[22] PCT Filed: Nov. 22, 1991

[86] PCT No.: PCT/AT91/00121

§ 371 Date: Jul. 14, 1993

§ 102(e) Date: Jul. 14, 1993

[87] PCT Pub. No.: WO92/09361

PCT Pub. Date: Jun. 11, 1992

[30] Foreign Application Priority Data

Nov. 23, 1990 [AT] Austria ..... A2384/90

[51] Int. Cl.[5] ..... B01F 13/06; B01F 9/02; B01F 15/06

[52] U.S. Cl. ..... 366/139; 366/144; 366/220; 366/235

[58] Field of Search ..... 366/139, 144, 149, 145, 366/146, 220, 235, 14, 15, 54

[56] References Cited

U.S. PATENT DOCUMENTS

| | | | |
|---|---|---|---|
| 2,297,804 | 10/1942 | Siegfried | 366/235 |
| 2,376,106 | 5/1945 | Witthofft | 366/220 |
| 4,831,959 | 3/1989 | Turner . | |

FOREIGN PATENT DOCUMENTS

| | | |
|---|---|---|
| 130850 | 2/1900 | Fed. Rep. of Germany . |
| 2323579 | 1/1974 | Fed. Rep. of Germany . |
| 340462 | 1/1931 | United Kingdom . |
| 792240 | 3/1958 | United Kingdom . |

*Primary Examiner*—Robert W. Jenkins
*Attorney, Agent, or Firm*—Cushman, Darby & Cushman

[57] ABSTRACT

In a device for mixing, homogenizing or reacting at least two, in particular flowable or pourable, components, having a container (1) rotatably seated around an axis, with at least one closable opening (10, 11, 12, 14) for filling and/or emptying the container, the container (1) is formed of at least two separately drivable pipe lengths (2, 16, 17) which are in open connection with each other. The pipe lengths (2) are furthermore sealingly seated at their ends (5) facing each other, the ends of the container (1) which are on the outside in an axial direction respectively have a sealingly closing end wall (7) and at least one sealingly closing end wall (7) is embodied displaceable in the axial direction of the pipe lengths (2).

14 Claims, 5 Drawing Sheets

DEVICE FOR MIXING, HOMOGENIZING OR REACTING AT LEAST TWO COMPONENTS

Figure 1:
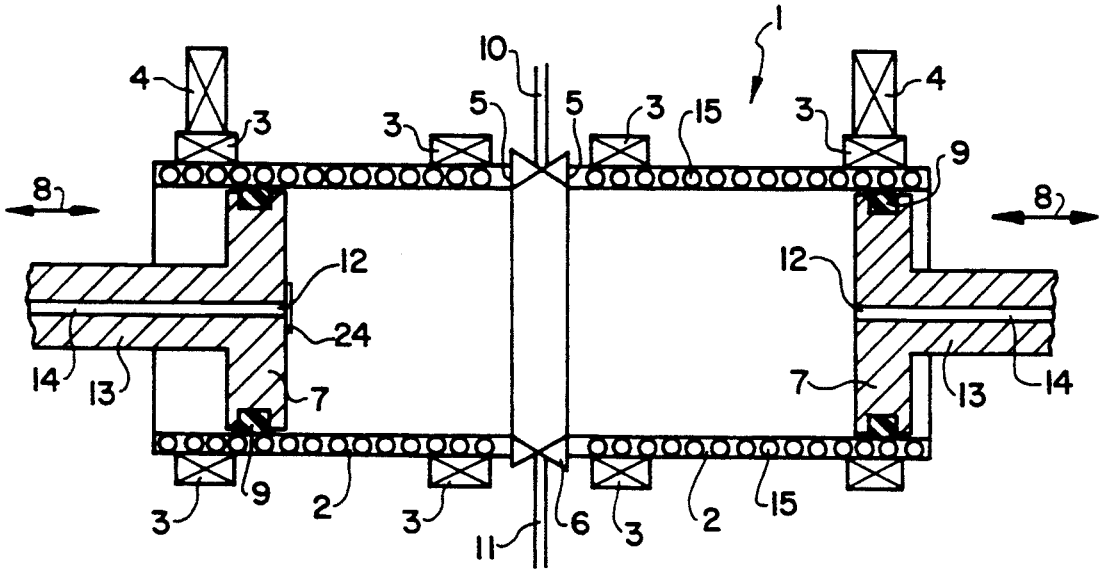

The invention relates to a device for mixing, homogenizing or reacting at least two, in particular flowable or pourable, components, having a container rotatably seated around an axis and drivable to perform a rotating movement, with at least one closable opening for filling and/or emptying the container.

Mixing devices, wherein a container into which a stirrer is inserted and its shaft is driven to perform a rotating movement, are known in the chemical industry, for example. A number of embodiments of a mixer shaft have been disclosed for mixing viscous or pasty materials, wherein the stirrers or mixing tools must be subjected to relatively elaborate cleaning at the end of the mixing process, depending on the nature of the materials.

In certain cases the use of a mixing tool can result in local heating of the mixed material in the immediate vicinity of the mixing tool, which can also lead to inhomogeneities in the temperature distribution in the immediate vicinity of the mixing tool if such mixing tools are operated at high speeds. The energy transfer during such a mixing process using a mixing tool is subject to losses in respect to the frictional heat occurring between the mixing tool and the material to be mixed and, if it is intended in particular at the same time to achieve a homogeneous heating of the compounds to be mixed, such heat cannot be transferred to the components to be mixed without losses.

It is therefore the object of the invention to provide a device of the mentioned type by means of which it is possible to transfer the expended mechanical energy directly into the material to be mixed, by means of which it is possible to omit separate mixing tools which occasionally must be cleaned and which, in addition, offers an opportunity to adapt the mixing parameters, in particular the extent of homogenization or a homogeneous temperature distribution desired for the chemical reaction, to the respective requirements without disruptive losses. To attain this object, the device essentially is such that it consists of a container which is formed of at least two separately drivable pipe lengths which are in open connection with each other, that the pipe lengths are sealingly seated at their ends facing each other, that the ends of the container which are on the outside in an axial direction respectively have a sealingly closing end wall and that at least one sealingly closing end wall is embodied displaceable in the axial direction of the pipe lengths. Because only the individual partial sections of the container in the form of separately drivable pipe lengths are made to rotate, a mixing zone is formed in the section of the ends of two such pipe lengths facing each other, wherein the mechanical energy transmitted to the components to be mixed by the rotation of the pipe lengths is made directly available to the individual particles of the mixture in the region of the mixing zone. A particularly homogeneous mixing is attained in this way in the mixing zone and, because at least one of the front walls is embodied to be displaceable in the axial direction of the pipe lengths, there is another possibility for affecting the result of the mixing, besides the variation of the rpm of the lengths of pipe or the direction of rotation of the pipe lengths. By applying compression pressure it is possible, depending on the type and consistency of the components to be mixed with each other, to control the mixing effect in the mixing area, and a pressure increase in particular is made possible for the also desired chemical reaction of such components with each other, which in part really makes possible the execution of such chemical reactions. Because of the ability to displace at least one front wall in the axial direction of the pipe lengths, a possibility is provided in addition to operate semi-continuously or continuously, and it is possible in particular to remove by means of the axial displacement of at least one front wall possibly enclosed gases or gases produced in the course of a chemical reaction separately from the reaction product or the mixing product, because such gases remain in an area close to the axis of the container during faster rotation of the container wall because of their lesser specific mass. Homogenization and mixing is controlled over wide ranges by selecting suitable rpm and it is possible, in particular with components with greatly different specific mass or during mixing or reacting of liquids with solid materials, to assure by the directed introduction of the specific components to be reacted or mixed a sufficient way for complete reaction or complete mixing from an area close to the center toward the direction of the jacket of the rotatable container. In this case the individual pipe lengths can be driven in the same direction and with different rotational speeds, in which case particularly intensive mixing naturally occurs if adjoining pipe lengths are driven in opposite directions. To assure that the entire amount of material to be mixed passes through the mixing zone between adjoiningly connected pipe lengths, it is possible by means of displacing at least one front wall and simultaneous pushing out of already mixed or reacted materials to convey the material to be mixed or reacted through the mixing zone. A continuous mode of operation is also possible in this way.

The shape and extension of the mixing zones being formed in particular between adjoiningly connected front walls can be adapted to different requirements made on the mixing or reaction process, in that preferably the axes of the pipe lengths are disposed coaxially in respect to each other or are disposed so that they enclose an obtuse angle between them. In case of the disposition of the axes at an obtuse angle, it is possible to achieve a kneading effect in the area of the mixing zone, which aids the intermixing of the at least two components.

For such a continuous process operation, the device can be advantageously embodied further in such a way that at least one front wall contains an axial opening, particularly one in the form of a screen, for filling and/or emptying the container. In this case, such an axial opening for filling and/or emptying the container can be securely sealed even at relatively high pressure, taking into account the rather slow circumferential speed in the vicinity of the axis.

To assure secure seating and a simple rotary drive for the pipe lengths which can be driven separately from each other, the embodiment has been provided in an advantageous manner such that the rotary drives for the pipe lengths disposed next to each other in the axial direction act on the respective outer circumference of the pipe lengths and that the pipe lengths are preferably supported on their circumference in bearings. Such an embodiment makes it possible to control even high rpm securely with little structural outlay.

The embodiment for sealing the facing front ends of the pipe lengths is provided in a simple manner in such a way that in the area of the facing front ends of the pipe lengths a bearing ring is provided, which cooperates in a sealing manner with the front ends of the pipe lengths, wherein such an embodiment can be further advantageously improved in that at least one opening for filling and/or emptying of the container extends through the bearing ring which is particularly fixed in place. The disposition of an opening for filling and/or emptying the container in such a stationary bearing ring is naturally connected with the least outlay for sealing and is especially advantageous particularly when employing large pressure forces during the mixing process or during the reaction.

To assure secure sealing of adjoining pipe lengths during large differences in rpm and in particular during oppositely turning rotational movements of adjoining pipe lengths, the embodiment with the use of a bearing ring has been advantageously provided in such a way that a stationary bearing ring is disposed between adjoining pipe lengths which, with the interposition of sealing elements, is connected with facing front faces of the front ends of the pipe length.

In an embodiment wherein the bearing ring extends over the facing front ends of the pipe lengths, the removal of the mixing or reaction product can take place in accordance with a preferred embodiment in such a way that at least one front end of a pipe lengths can be displaced in the bearing ring. By means of this a precise setting of a separating gap between facing front faces is made possible, through which gap material of a defined grain size can escape.

To further increase the mixing effect and in particular to admix hard-to-mix components homogeneously with each other in a short period of time, the embodiment has been advantageously provided such that both sealingly closing front walls are displaceable in the axial direction and can be driven separately or coupled together for a mutual movement. With an embodiment of this type it is possible, particularly when coupling the movement of the front walls to perform a movement in the same direction, to convey the material to be mixed several times through the mixing zone between adjoining pipe lengths, because of which intimate and rapid mixing is assured.

Particularly for performing chemical reactions or for mixing sensitive components, which are only allowed to be mixed with each other in the presence of an inert gas or with the exclusion of oxygen, the embodiment has been advantageously provided such, that the container is equipped with at least one opening for applying a vacuum. If necessary, it is also possible to force an inert gas through such a connection.

In a structurally particularly simple manner the embodiment has been provided such that the common axis of the pipe lengths is essentially horizontally disposed, wherein the pipe lengths may have heating and/or cooling devices on their jackets for optimizing chemical reactions or mixing processes.

For adapting the inside of the container formed by the pipe lengths to the consistency of the mixing materials, the embodiment has been preferably provided in such a way that the face of the front walls facing the interior of the pipe lengths has a surface which differs from a level surface extending normally on the axis of the corresponding pipe length. By means of inner surfaces of the front walls extending, for example, inclined in respect to the pipe axis, it is possible in this case to introduce additional movement components, besides the components caused by the rotation, into the material and to achieve in this way an acceleration of the mixing or reaction process.

The invention will described in detail below by means of exemplary embodiments schematically shown in the drawings. These show in FIG. 1 a section through a first embodiment of a device of the invention with two adjoiningly connected pipe lengths; in FIG. 2 a section through a variant embodiment of a device of the invention with three pipe lengths which are coaxial to each other; in FIG. 3 a section through another variant embodiment of a device of the invention, where only one of the adjoiningly connected pipe lengths has a movable front wall; in FIGS. 4, 5 and 6 sections through an embodiment similar to FIG. 1 at different points in time of a mixing or reaction process, wherein the adjoiningly connected pipe sections have opposite directions of rotation; in FIGS. 7, 8 and 9 a view similar to that of FIGS. 4 to 6 of different points in time of a mixing process, wherein the adjoiningly connected pipe lengths have the same direction of rotation and the same rpm; in FIG. 10 a view analogous to FIG. 7, wherein the adjoining pipe lengths have the same direction of rotation but different rpm; in FIG. 11 a section through another variant embodiment with pipe lengths displaceably seated in the bearing ring; in FIG. 12 a section through an embodiment wherein the axes of the pipe length enclose an obtuse angle with each other; and in FIG. 13*a, b, c* schematic views of variant surface structures for front walls sealing the pipe lengths at the free ends.

A container 1 for mixing, homogenizing or reacting at least two components is shown in FIG. 1, which is formed of two pipe lengths 2, disposed coaxially and adjoiningly connected with each other and in open connection with each other. The pipe lengths 2 are seated in schematically indicated bearings 3, where a separate drive 4 for each of the pipe lengths or a portion of a gear transmission is indicated in the area of the bearings. The pipe lengths 2 are sealingly connected with each other at the facing ends of their front ends 5 via a fixed bearing ring 6. Furthermore, a front wall 7, closing off the open ends of the pipe lengths 2, is provided in each one of the pipe lengths 2 shown in FIG. 1 and is movable in the direction of the two-headed arrows 8 in the axial direction. Seals 9 are indicated here on the outer circumferences of the front walls 7. For filling and emptying the container 1, formed by the pipe ends disposed coaxially to each other and operable separately from each other, the bearing ring 6 has access openings into the interior of the container, which are indicated by 10 and 11. In addition or alternatively to such openings in the bearing ring 6, it is also possible to provide access openings 12 in the area of the front walls 7, which are in contact with channels 14, extending essentially axially through the axes 13 of the front walls 7. In this case an opening 12 specifically designed for emptying is equipped with a schematically indicated screen 24.

It is necessary for a multitude of mixing processes or homogenizing processes or reaction processes to maintain different process parameters in addition to executing a mixing process. The pipe lengths 2 have cooling and/or heating devices on their jackets for setting defined temperature conditions, but for the sake of clarity the connections to such cooling and/or heating devices 15 are not shown. In place of such devices integrated into the jacket it is also possible for instance to provide radiating devices enclosing the outer circumference of the pipe lengths.

In the subsequent drawing figures the reference numerals from FIG. 1 have been retained for similar parts. In addition, only the more essential components are shown for the sake of clarity, so that the illustration of the bearings and drives in particular, as well as the different possibilities for supply and/or emptying openings have been omitted.

Figure 2:
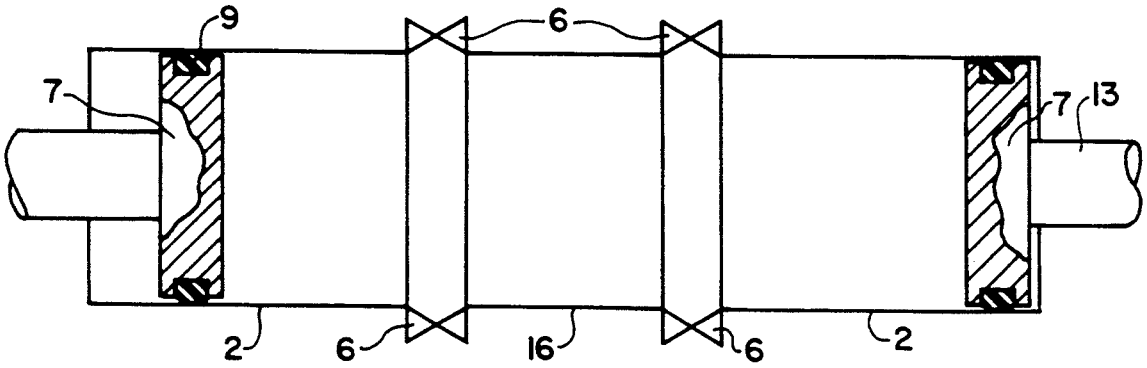

An embodiment is shown in FIG. 2 in which three pipe lengths 2 or 16, which are coaxial in respect to each other, are used. The pipe lengths 2 on the outside are embodied similar to the pipe lengths in FIG. 1 and again have front walls 7 for closing off their open end located at the outside, which are displaceable separately from each other. Depending on the requirements, it is possible to drive the center pipe length 16 in the opposite direction to the outer pipe lengths 2, for example, wherein the front faces of the pipe lengths 2 or 16 facing each other are again connected via a fixed bearing ring 6.

Figure 3:
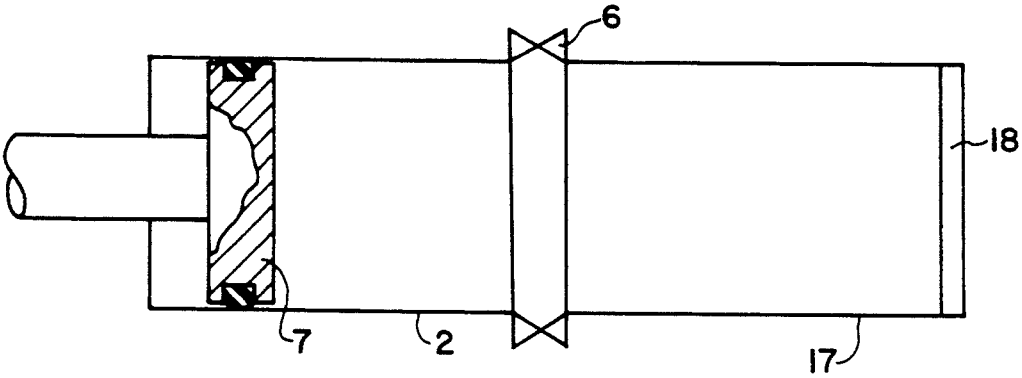

In the embodiment in accordance with FIG. 3, a pipe length 2 with a movable front wall 7 and a second pipe length 17 with a rigid wall 18 are employed. Such an embodiment can be selected, for example, if the pipe length 17 is intended to be embodied as a removable end packing drum which, following the mixing or reaction operation, is detached from the pipe length 17 and forwarded to a user, for example. Because of the movable front wall 7 of the adjoining pipe length 2, it becomes possible here in the course of the mixing operation to transfer the mix or the reacted products into the vessel or packing drum formed by the pipe length 7.

Figure 4:
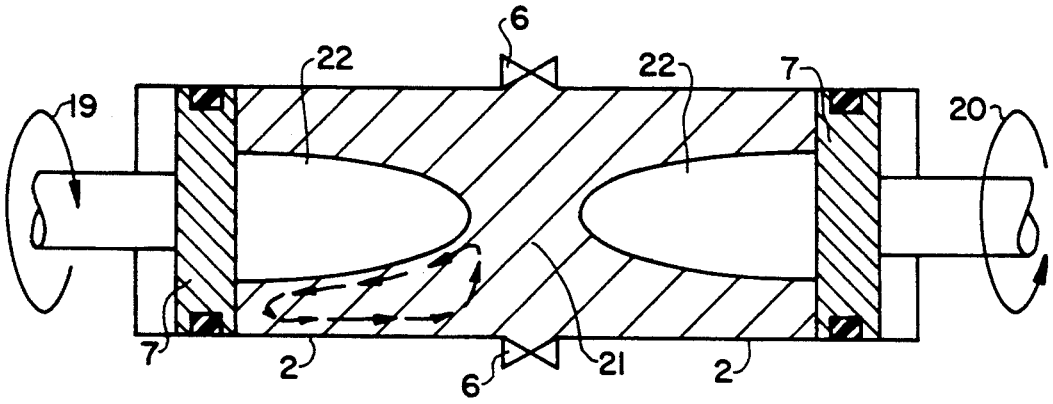
Figure 5:
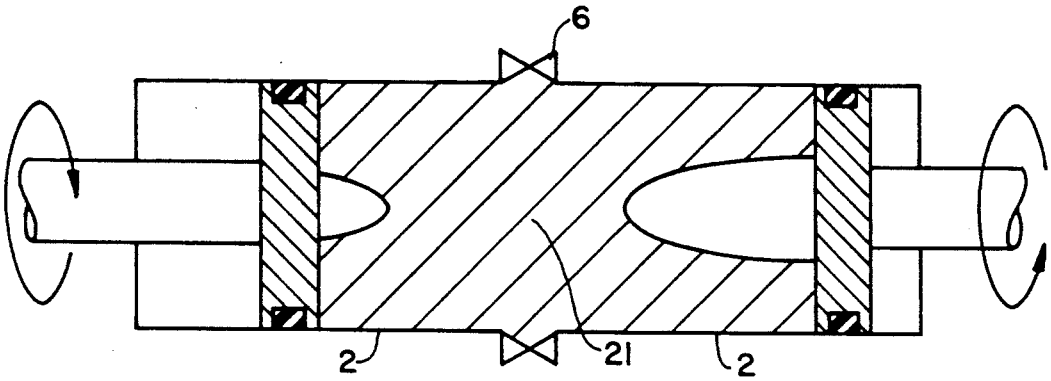
Figure 6:
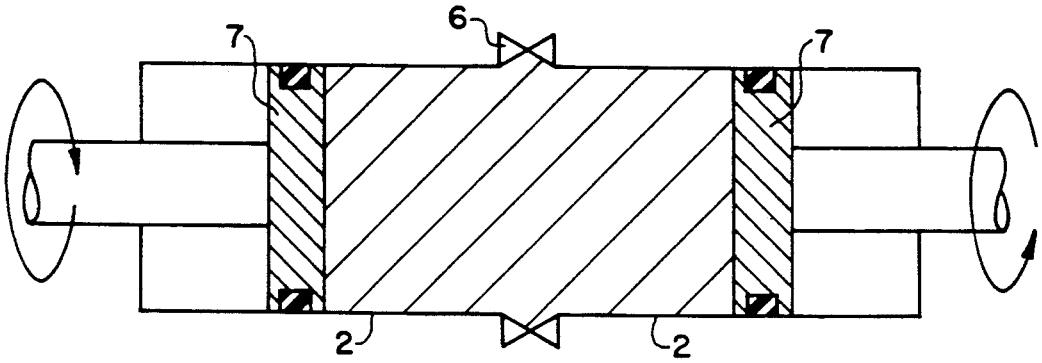

Various points in time of a mixing or homogenizing process are shown in FIGS. 4, 5 and 6, wherein the adjoiningly connected pipe lengths 2 are driven in the opposite direction from each other as indicated by the arrows 19 and 20. Supply of material is to be accomplished via supply lines, not shown in detail, in the area of the fixed bearing ring 6, and a friction or mixing zone 21 will be formed in the area of the fixed bearing ring during the mixing operation. In addition, in the course of the continued mixing or homogenizing operation, the air-filled areas 22 are reduced and excess air or gas can be vented through the axis of the front walls 7, for example. By moving the front walls 7 it is possible in this case to bring the material to be mixed or reacted or homogenized into the area of the bearing ring 6 for a defined period of time, in which the main mixing process takes place in the mixing or friction zone 21.

Figure 7:
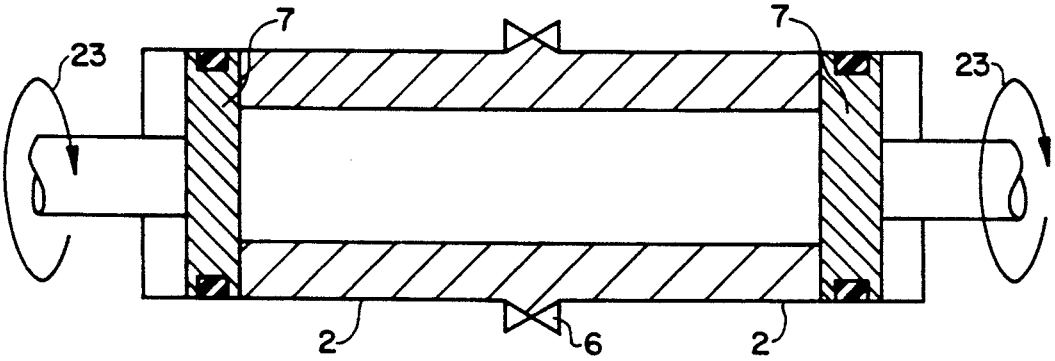
Figure 8:
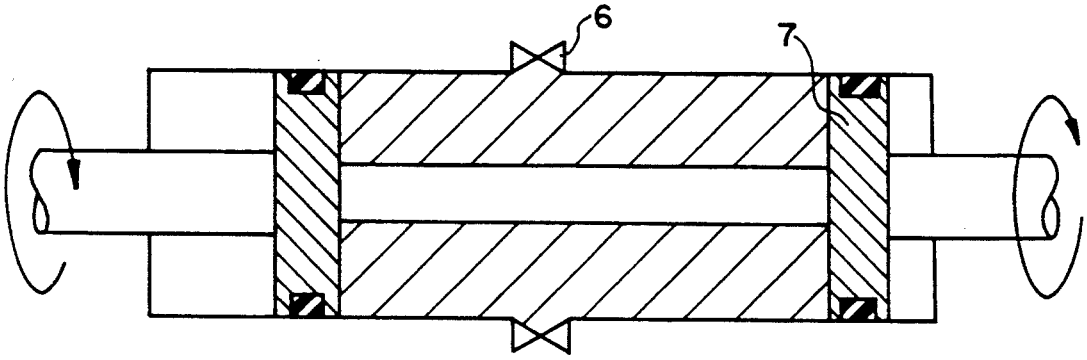
Figure 9:
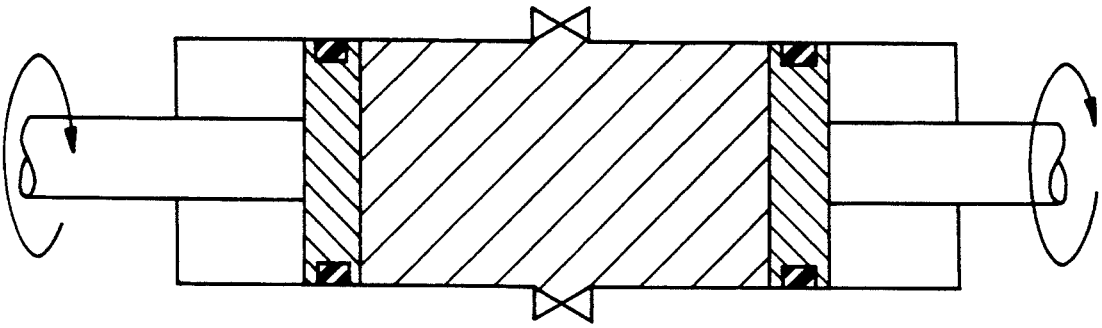

A process is shown in FIGS. 7, 8 and 9, wherein the adjoiningly connected pipe lengths 2 are driven in the same direction of rotation 23 at the same rpm. Again, the supply of material to be mixed or reacted or homogenized is achieved through the fixed bearing ring 6 between the front faces of the pipe lengths 2. At the start of the mixing process in this type of operation the materials will preferably adhere to the interior circumference of the pipe lengths 2, in which case it is again possible to remove a remaining amount of air present in the container via at least one central opening in a front wall 7. It is again possible to bring the material into the area of the fixed bearing ring in accordance with the requirements by moving the front walls 7.

Figure 10:
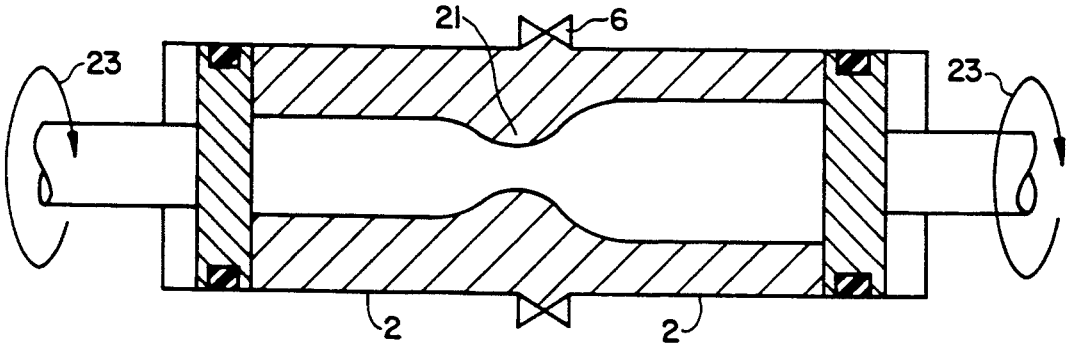

In the view according to FIG. 10, the pipe lengths 2 are driven in the same direction of rotation 23, but at different rpm. In this way, a mixing or friction zone 21 is again formed in the area of the bearing ring 6, in which a particularly intensive mixing or homogenization of the inserted components takes place.

Figure 11:
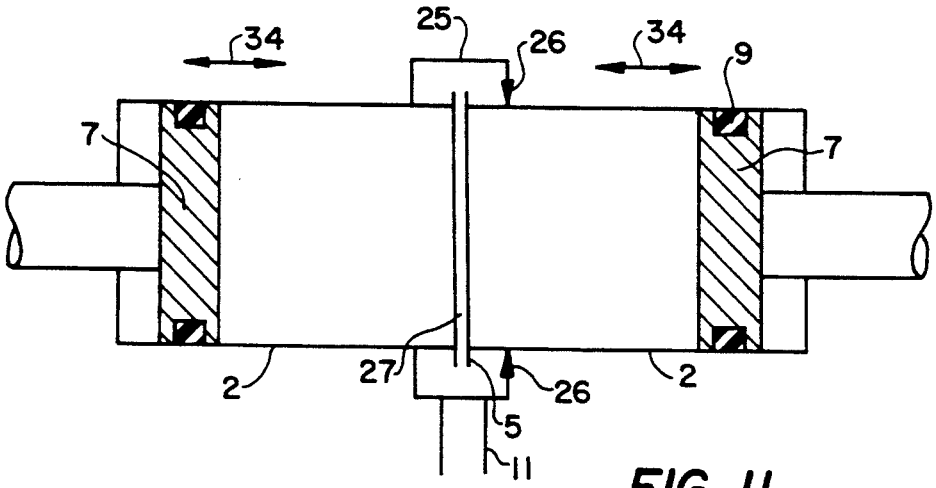

A sealing connection of the facing ends of the pipe lengths 2 which differs from those of the preceding drawing figures is shown in the embodiment illustrated in FIG. 11. In this case a stationary bearing ring 25 which extends over the front ends 5 is used, wherein sealing faces of the bearing ring 25 which cooperate with the outer surfaces of the pipe lengths 2 are schematically indicated by 26. In this embodiment the discharge of the mixed or reacted material takes place via a separating gap 27, which can be adjusted between the facing front end 5 of the pipe lengths 2, wherein, subsequently to the completion of the mixing or reaction, at least one of these pipe lengths 2 is guided in the bearing ring 25 displaceable in the direction of the long axis in the direction of the two-headed arrow 34 for adjusting this separating gap 27. At the end of the completed mixing or reacting operation, the material exits through the separating gap 27, which has been set to a defined grain size, into the interior of the bearing ring 25 and is drawn off through it via the opening 11.

In the embodiments shown above, the axis of the mixing container 1 formed by at least two coaxial pipe lengths 2 extends essentially horizontally. In accordance with the requirements, it is naturally also possible to select an arrangement inclined in respect to the horizontal direction or a vertical arrangement.

Figure 12:
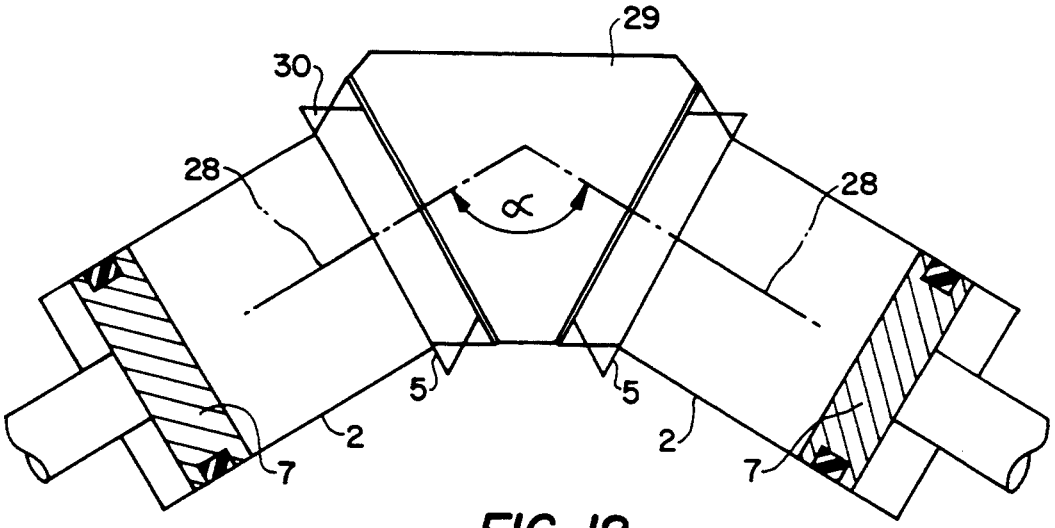

In the embodiment in accordance with FIG. 12, the axes 28 of the pipe lengths 2 which are in an open connection with each other enclose an obtuse angle $\alpha$. In this case an appropriately formed stationary bearing ring 29 is used, wherein the bearings cooperating with the front ends 5 of the pipe lengths 2 are designated by 30. With an embodiment of this type, the mixing zone being generated in the area of the connection of the pipe lengths has an asymmetrical shape wherein, because of the rotational movement of the pipe lengths 2, a kneading effect and in connection with this an accelerated mixing process can be performed because, on account of the inclined position of the axes 28, the material adhering to the interior surfaces of the pipe lengths 2 is subjected to different additional movements as a function of the position, in particular essentially in the axial direction.

Figure 13A:
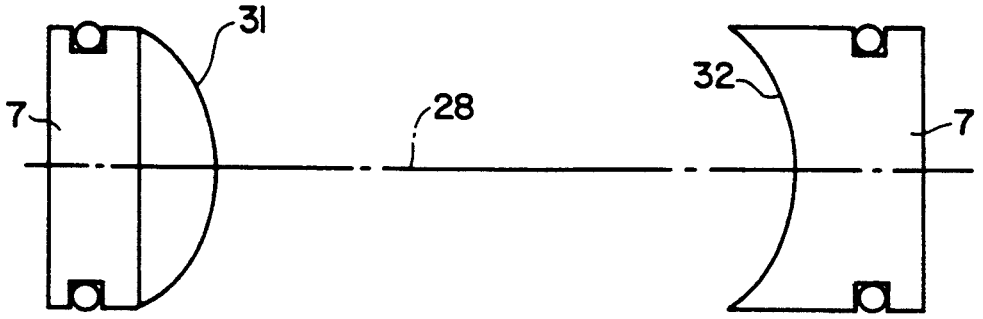
Figure 13B:
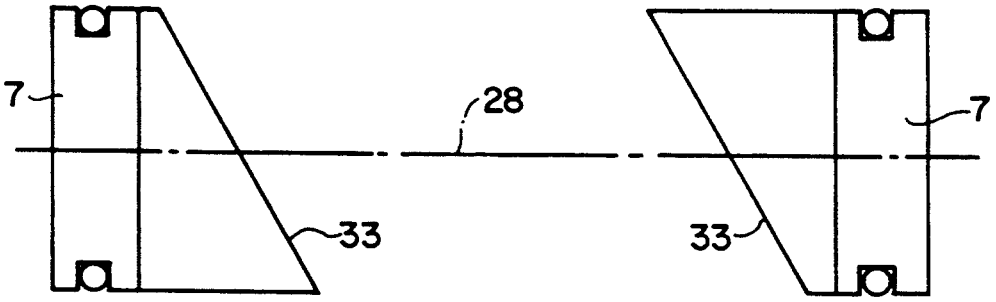
Figure 13C:
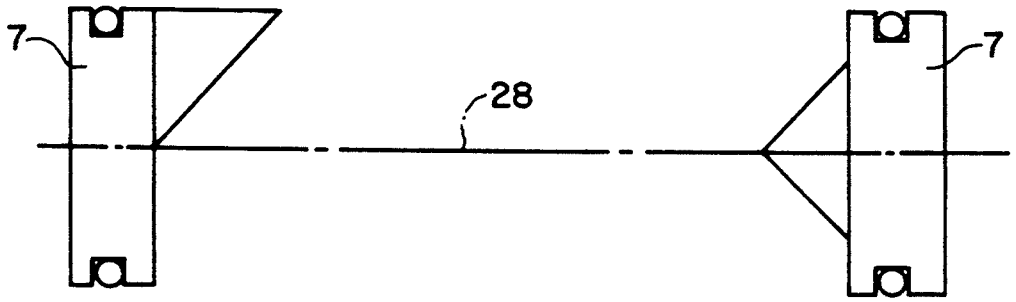

In the views in accordance with FIG. 13 only the exterior front walls 7 of pipe sections, not shown in detail, are shown, wherein the interior surfaces have a shape differing from the shape of a surface which normally stands on the schematically indicated axes 28 of the pipe lengths. In FIG. 13*a* a convex and in FIG. 13*b* a concave surface 31 or 32 are shown. In the embodiment in accordance with FIG. 13*b*, surfaces 33 are used which extend inclined in respect to the axis 28, and in the embodiment in accordance with FIG. 13*c* only partial areas of the surface of the front walls 7 facing the interior have a surface shape different from that of a plane extending normally on the axis 28. In this case structures are used which are triangular in cross section. In the embodiments in accordance with FIGS. 13*b* and 13*c* in particular, movement components in an essentially axial direction of the pipe lengths are exerted, in addition to the forces exerted on the material by the rotational movement of the pipe lengths, because of which the mixing or reaction process is aided, and it is also possible to achieve particular mixing effects.

It is possible to achieve different mixing zones and intensities due to the fact that the rpm and the directions of rotation can be set and selected independently of each other, and furthermore at least one front wall can be moved in the direction of the axis of the mixing container formed by the pipe lengths. Thus, it is possible to process dry materials, liquids or pastes together, and it is possible to set the parameters for correct mixing, homogenization or reaction within wide ranges by the use of cooling and/or heating devices and compacting pressures which can be applied through the front walls. All in all, the result is a simple adaptation of the adjustable parameters, such as direction of rotation, rotational speed, compacting pressure of the front walls, temperature and the like, to the consistency of the material, because of which a very rapid mixture of the entire material can be achieved. The heat generated during mixing is created directly in the material and it is possible to aid the adjustment of the temperature by additional heating and cooling processes, as mentioned above, which in this way takes place evenly and rapidly by an interchange over a large surface. The openings or supply lines provided in the bearing ring and/or the front walls naturally need not only be used for the supply of material and the removal of the mixed or reacted products, but also for the application of a vacuum or charging with an inert gas or protective gas, for example.

For aiding the mixing or reacting or homogenizing process in the interior of the container 1 it is also possible that the latter contain small friction bodies.

A continuous mode of operation can here be provided in that the material to be mixed is supplied continuously via a supply device 13 disposed in the front wall 7 and is removed through the opening 12 provided in the opposite front wall 7, which for example is provided with a screen, as indicated in FIG. 1. Instead of continuous operation, the material can be supplied in batches, in which case the mixing product or the reaction product is again removed at the end of the mixing process by moving at least one front wall, for example through the opening 12 provided in the opposite front wall 7.

I claim:

1. A device for mixing, homogenizing or reacting at least two flowable or pourable components, comprising a container (1) drivable to perform rotating movement about an axis, and having at least one closeable opening (10, 11, 12, 14) for filling and/or emptying the container (1), wherein: the container (1) is formed from at least two separately drivable pipe lengths (2, 16, 17) arranged in mating end-to-end relationship, the mating ends of the pipe lengths (2, 16, 17) being seated within a seal; and wherein non-mating ends of the pipe lengths at opposite ends of the container have a sealingly closing end wall (7, 18) at least one of which is displaceable in the axial direction of the respective pipe lengths (12, 16, 17).

2. A device in accordance with claim 1, wherein the axes of mating pipe lengths (2, 16, 17) are disposed in respect to each other in a range extending between a coaxial relationship and one in which the axes are at an obtuse angle with respect to one another.

3. A device in accordance with claim 1 or 2, characterized in that at least one end wall (7) has an axial opening (12), covered by a screen (24), for filling and/or emptying the container (1).

4. A device in accordance with claims 1 or 2, characterized in that rotary drives (4) for the pipe lengths (2, 16, 17) are disposed next to each other in the axial direction of the container and act on the respective exterior circumference of the pipe lengths.

5. A device in accordance with one of claims 1 or 2, characterized in that the pipe lengths (2, 16, 17) are supported in bearings (3) on their exterior circumference.

6. A device in accordance with one of claims 1 or 2, characterized in that a bearing ring (6, 25, 30) is provided in the area of the mating ends of the pipe lengths (2, 16, 17), which cooperates sealingly with the mating ends (5) of the pipe lengths (2, 16, 17).

7. A device in accordance with claim 6, characterized in that at least one opening (10, 11) for filling and/or emptying the container (1) extends through the bearing ring (6,25).

8. A device in accordance with claim 6, wherein the bearing ring (25) is stationary and is connected, with the interposition of sealing elements (26), to mating ends of the pipe lengths (2).

9. A device in accordance with one of claim 6, characterized in that at least one mating end (5) of a pipe length (2) is displaceably seated in the bearing ring (25).

10. A device in accordance with claims 1 or 2, wherein both sealingly closing end walls are displaceable in the axial direction of their respective pipe lengths.

11. A device in accordance with one of claims 1 or 2, characterized in that the container (1) is provided with at least one opening (10, 11, 12, 14) for applying a vacuum.

12. A device in accordance with claim 2, wherein the axes of mating pipe lengths (2,16, 17) are coaxial and essentially disposed horizontally.

13. A device in accordance with one of claims 1 or 2, characterized in that the pipe lengths (2, 16, 17) have heating and/or cooling devices (15) on their jackets.

14. A device in accordance with claims 1 or 2 wherein the surfaces of the closing end walls facing the interior of the pipe lengths (2, 16, 17) have surfaces which extend other than normal to the axes of the respective pipe lengths.

* * * * *